US012270549B2

(12) United States Patent
Warren et al.

(10) Patent No.: US 12,270,549 B2
(45) Date of Patent: Apr. 8, 2025

(54) RECONFIGURABLE PATIO HEATER AND UMBRELLA ASSEMBLIES

(71) Applicant: Telescope Casual Furniture, Inc., Granville, NY (US)

(72) Inventors: Kaitlynn Warren, Pawlet, VT (US); William Vanderminden, Fort Edward, NY (US)

(73) Assignee: Telescope Casual Furniture, Inc., Granville, NY (US)

( * ) Notice: Subject to any disclaimer, the term of this patent is extended or adjusted under 35 U.S.C. 154(b) by 585 days.

(21) Appl. No.: 17/804,386

(22) Filed: May 27, 2022

(65) Prior Publication Data

US 2023/0383951 A1 Nov. 30, 2023

(51) Int. Cl.
*F24C 1/08* (2021.01)
*A47B 37/04* (2006.01)

(52) U.S. Cl.
CPC ..... *F24C 1/08* (2013.01); *A47B 37/04* (2013.01)

(58) Field of Classification Search
CPC ..... F24C 1/08; A47B 37/04
See application file for complete search history.

(56) References Cited

U.S. PATENT DOCUMENTS 5,711,333 A 1/1998 Vanderminden, Sr.
5,775,315 A * 7/1998 Baykal ..... A47J 37/0781 126/26
5,871,024 A 2/1999 Vanderminden, Sr.
D450,816 S 11/2001 Bilotti
6,470,877 B1 10/2002 Waters
7,044,064 B2 * 5/2006 Li ..... A47B 37/04 108/50.12
D550,950 S 9/2007 Vanderminden
7,296,522 B1 11/2007 Mahmalji
D563,537 S 3/2008 McColgin et al.
D567,916 S 4/2008 McColgin et al.
7,363,930 B2 4/2008 Vanderminden, Sr.
8,230,869 B2 7/2012 Vanderminden, Sr.
8,302,616 B2 11/2012 Vanderminden, Sr.
(Continued)

OTHER PUBLICATIONS

Offer up listing dated 6 years ago https://offerup.com/item/detail/431066153 , 3 pages (Year: 2018).
(Continued)

*Primary Examiner* — Ko-Wei Lin
(74) *Attorney, Agent, or Firm* — Heslin Rothenberg Farley & Mesiti P.C.

(57) ABSTRACT

Reconfigurable assemblies include, for example, a housing assembly, a heater assembly, and an umbrella assembly. The housing assembly includes a cavity for receiving a tank. The heater assembly includes a heater, a post having a lower portion and an upper portion, and the heater attached to the upper end of the post. The umbrella assembly includes a canopy and a pole. In a first configuration the lower portion of the post of the heater assembly is operably attached to the housing assembly to define a patio heater assembly. In a second configuration the lower portion of the pole of the umbrella assembly is operably attached to the housing assembly to define a patio umbrella assembly. The heater assembly and umbrella assembly may be usable with and positioned in the center of conventional tables.

33 Claims, 14 Drawing Sheets

(56) References Cited

U.S. PATENT DOCUMENTS

| | | | | |
|---|---|---|---|---|
| 8,734,928 | B1 | 5/2014 | LaVigna et al. | |
| 8,863,673 | B2 * | 10/2014 | Diepenbrock | A47B 13/00 108/50.13 |
| 9,149,097 | B1 | 10/2015 | Davis | |
| 10,030,889 | B2 | 7/2018 | Merritt | |
| 10,488,052 | B2 | 11/2019 | Kalyanaraman et al. | |
| D876,811 | S | 3/2020 | Vanderminden | |
| 2003/0056782 | A1 | 3/2003 | Liang | |
| 2005/0034638 | A1 * | 2/2005 | Li | A47B 11/00 108/50.12 |
| 2007/0062418 | A1 * | 3/2007 | Li | A47B 11/00 108/50.12 |
| 2009/0223512 | A1 | 9/2009 | Konkle | |
| 2013/0239943 | A1 * | 9/2013 | James | F24C 1/08 29/525.01 |
| 2021/0085075 | A1 * | 3/2021 | Volin | A47B 37/04 |
| 2023/0383951 | A1 | 11/2023 | Warren et al. | |

OTHER PUBLICATIONS

Kaitlynn Warren et al. Design U.S. Appl. No. 29/864,426, filed May 27, 2022, entitled "Patio Heater".

Propane Patio Heater, available from Telescope Casual Furniture, Inc., Granville, New York, Telescope Casual 2022 Catalog, pp. 1, 92, and 93, Jul. 1, 2021.

Trash/Towel Receptacle, available from Telescope Casual Furniture, Inc., Granville, New York, Telescope Casual 2021 Catalog, pp. 1 and 93, Jul. 1, 2020.

* cited by examiner

RECONFIGURABLE PATIO HEATER AND UMBRELLA ASSEMBLIES

CROSS-REFERENCE TO RELATED APPLICATION

This application is related to commonly assigned, co-filed U.S. design patent application Ser. No. 29/864,426, filed on May 27, 2022, by Warren et al., entitled "Patio Heater", which application is incorporated herein by reference in its entirety.

FIELD OF THE DISCLOSURE

The present disclosure relates generally to patio heaters, and more particularly to patio heater assemblies having a heater assembly and a housing assembly and in which the heater assembly is replaceable with an umbrella assembly, and in which the heater assembly and umbrella assembly are alternatively usable with and positionable in the center of conventional tables.

BACKGROUND

Patio heaters are devices for generating radiant heat such as for outdoor use. Patio heaters typically include a cylindrical housing that is sized to contain a fuel tank therein, a post connected to the housing projects upwardly therefrom, and a burner assembly is attached to the upper end of the post for combusting fuel from the tank.

Patio umbrellas typically are connected to an umbrella base to maintain the umbrella in an upright position. Conventional umbrella bases are typically made from a single piece of cast iron or cast aluminum, or formed form a hollow plastic material having a weighting material disposed therein. The base is disposed on the ground and the pole of the umbrella extends from the base to the canopy.

SUMMARY

Shortcomings of the prior art are overcome and additional advantages are provided through the provision, in one embodiment, of a method for reconfiguring an assembly as a heater assembly or as a patio umbrella assembly, which includes, for example, providing a patio heater assembly, a housing assembly, and an umbrella assembly. The heater assembly includes a heater, and a post having a lower portion and an upper portion. The heater is attached to the upper end of the post. The housing assembly includes a housing with a cavity for receiving a tank, and the lower portion of the post of the heater assembly is operably connected to the housing assembly to form a patio heater assembly. The umbrella assembly includes a canopy, and a pole. A hose of the heater is disconnected from the tank. The lower portion of the post of the heater assembly is disconnected from the housing assembly. The lower portion of the post and a lower end of the hose is removed from the housing assembly. A lower portion of the pole of the umbrella assembly is operably connected to the housing assembly to form a patio umbrella assembly. The patio heater assembly and umbrella assembly may be alternatively disposed in the center of conventional tables having an aperture in the center of the top of the conventional tables.

In another embodiment, a method for reconfiguring an assembly as a patio heater assembly or as a patio umbrella assembly includes for example, providing a housing assembly having a cavity for receiving a tank, providing a heater assembly having a heater and a post having a lower portion and an upper portion, providing an umbrella assembly having a canopy and a pole, and alternately attaching the heater assembly to the housing assembly to form in a first configuration a patio heater assembly, and attaching the umbrella assembly to the housing assembly to form in a second configuration a patio umbrella assembly. The patio heater assembly and umbrella assembly may be alternatively disposed in the center of conventional tables having an aperture in the center of the top of the conventional tables.

In another embodiment, a reconfigurable patio heater assembly and patio umbrella assembly is provided, which includes, for example, a housing assembly, a heater assembly, and an umbrella assembly. The housing assembly includes a cavity for receiving a tank. The heater assembly includes a heater, a post having a lower portion and an upper portion, and the heater is attached to the upper end of the post. The umbrella assembly includes a canopy and a pole. In a first configuration the lower portion of the post of the heater assembly is operably attached to the housing assembly to define a patio heater assembly. In a second configuration the lower portion of the pole of the umbrella assembly is operably attached to the housing assembly to define a patio umbrella assembly. The patio heater assembly and patio umbrella assembly may include a table, and the heater assembly and the umbrella assembly may be alternatively disposed in the center of the table having an aperture in the center of the top of the table.

In another embodiment, a patio heater assembly for use with a tank for storing fuel is provided, which includes, for example, a heater assembly and a housing assembly. The heater assembly includes a heater, and a hollow post having a lower portion and an upper portion. The heater is attached to the upper end of the post, and a hose extends from the heater to the lower end of the post. The housing assembly includes a top and at least one sidewall. The top and the at least one sidewall are sized to define a cavity for receiving the tank. The top has an aperture extending from the upper surface to the lower surface. The support operably connects the lower portion of the post to the housing assembly with the hose attachable to the tank. The patio heater assembly may be disposed in the center of conventional tables having an aperture in the center of the top of the conventional tables.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

The present disclosure and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the disclosure in detail. It should be understood, however, that the detailed description and the specific examples, while indicating embodiments of the present disclosure, are given by way of illustration only, and are not by way of limitation. Various substitutions, modifications, additions and/or arrangements within the spirit and/or scope of the underlying concepts will be apparent to those skilled in the art from this disclosure.

The present disclosure is directed to reconfigurable assemblies that may be alternatively configured in a first configuration as a patio heater assembly and in a second configuration as an umbrella assembly. For example, the patio heater assembly and patio umbrella assembly may be alternatively disposed in the center of conventional tables having a typical 2-inch diameter aperture in the center of the top of the tables. In some embodiments, the reconfigurable patio heater and umbrella assemblies may provide versatile use, such as providing heat in cooler environments and providing shade in warmer environments. For example, the umbrella assembly may be used during the day to provide shade to a group pf people sitting around a conventional table during the day, and exchanged in the evening with the heater assembly to direct radiant heat evenly to a group of people sitting around the conventional table at night.

Figure 1:
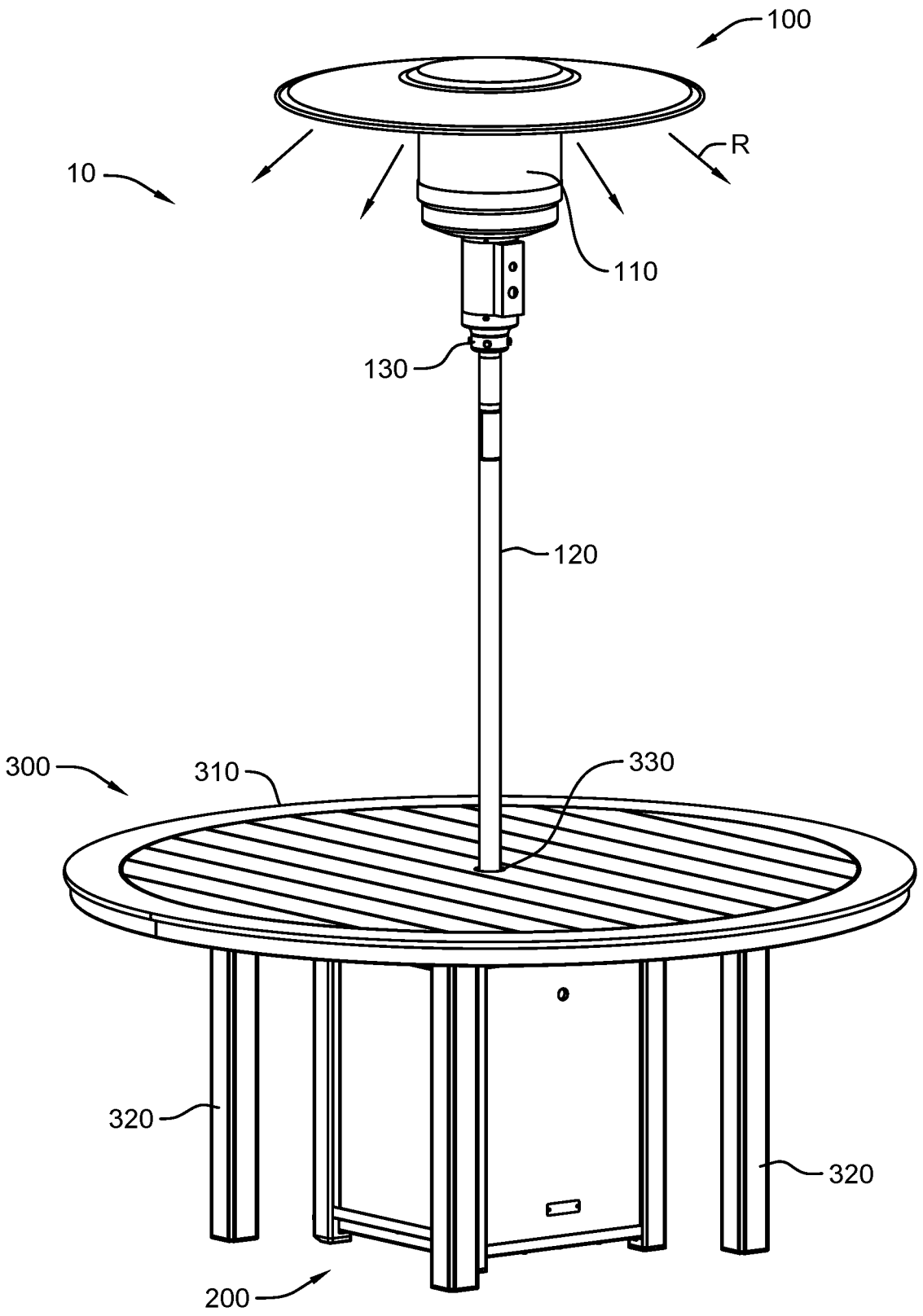
FIG. 1 is a perspective view of a reconfigurable assembly configured as a patio heater assembly, according to an embodiment of the present disclosure.

FIG. 1 illustrates a reconfigurable assembly configured a patio heater assembly 10, according to an embodiment of the present disclosure. In this illustrated embodiment, patio heater assembly 10 includes a heater assembly 100 supported on a housing assembly 200. Heater assembly 100 may include a heater 110 and a post 120. As described below, housing assembly 200 may include a tank for storing fuel for heater 110. Housing assembly 200 may be positioned below a conventional, standard, or other table 300 having a tabletop 310 and a plurality of legs 320. Top 310 may have an aperture 330 through which post 120 may extend with heater 110 centrally disposed above table 300. The heater assembly 100 may be operable to direct radiant heat R evenly to a group of people sitting around the table. Heater 110 may be a conventional heater, which is operably attached to the post extending between the heater 110 and housing assembly 200. For example, a coupling 130 may be employed having upper end sized to connect to the heater and a lower end sized to connect to post 120, and wherein upper end of the coupling has a larger diameter than the diameter of the second lower end of the coupling as further described below.

Figure 2:
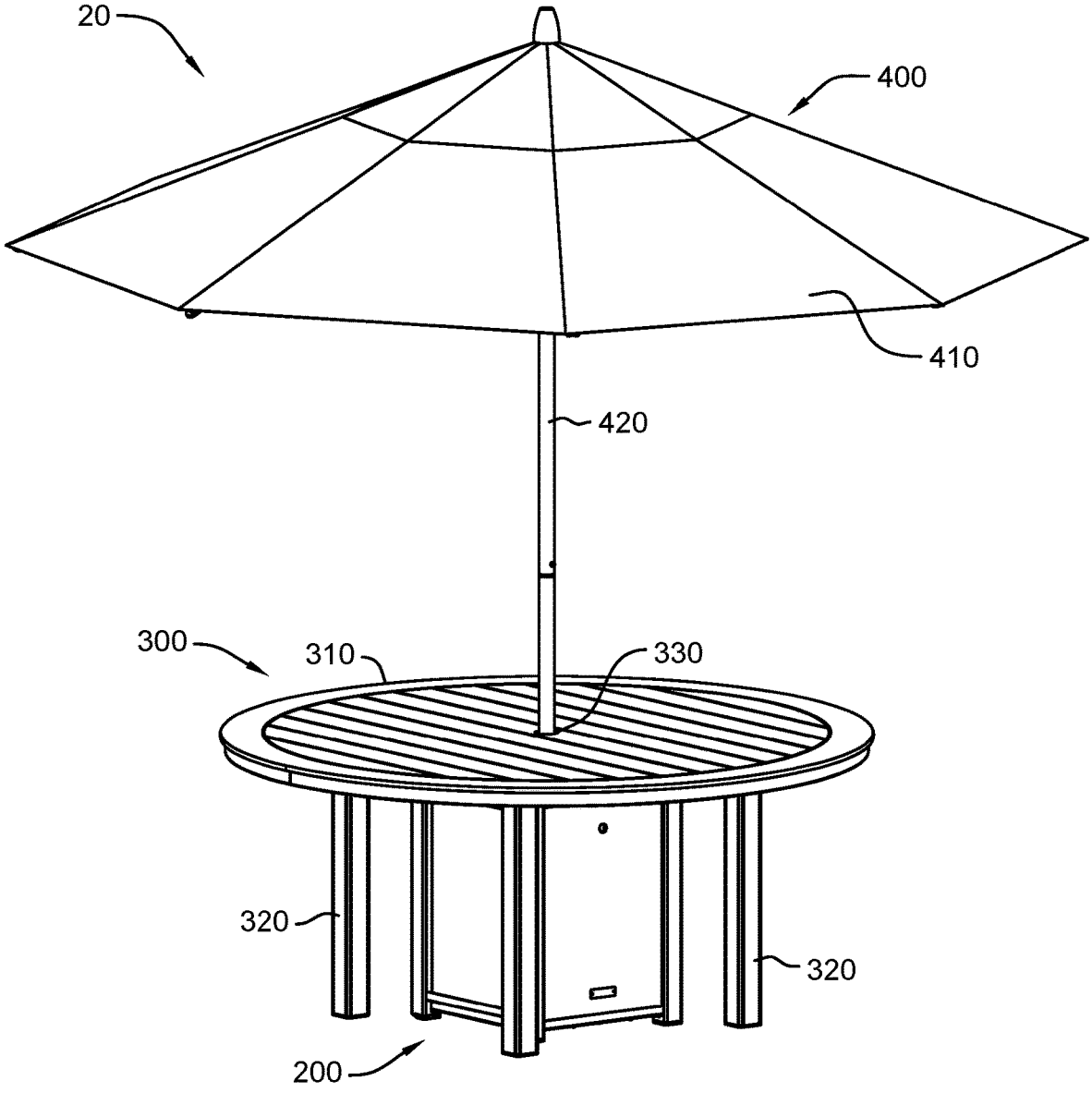
FIG. 2 is a perspective view of the reconfigurable assembly configured as an umbrella assembly, according to an embodiment of the present disclosure.

As shown in FIG. 2, the reconfigurable assembly may be configured as a patio umbrella assembly 20, according to an embodiment of the present disclosure. In this illustrated embodiment, patio umbrella assembly 20 includes an umbrella assembly 400 supported from housing assembly 200. Umbrella assembly 400 may include a canopy 410 and a pole 420. As described below, housing assembly 200 may include a plurality of weights for use in supporting umbrella assembly particularly during windy weather. Housing assembly 200 may be positioned below conventional, standard or other table 300 having tabletop 310 and the plurality of legs 320. Top 310 may have aperture 330 through which pole 420 may extend with umbrella assembly 20 centrally disposed above table 300.

Heater assembly 100 (FIG. 1) and the umbrella assembly 400 may be interchangeable with housing assembly 200 to provide heating and warmth during cooler temperatures, and to provide shade during warner sunny conditions. Heater assembly 100 (FIG. 1) and umbrella assembly 400 may be readily interchanged, for example, during the change of seasons, or between day and night times.

Figure 3:
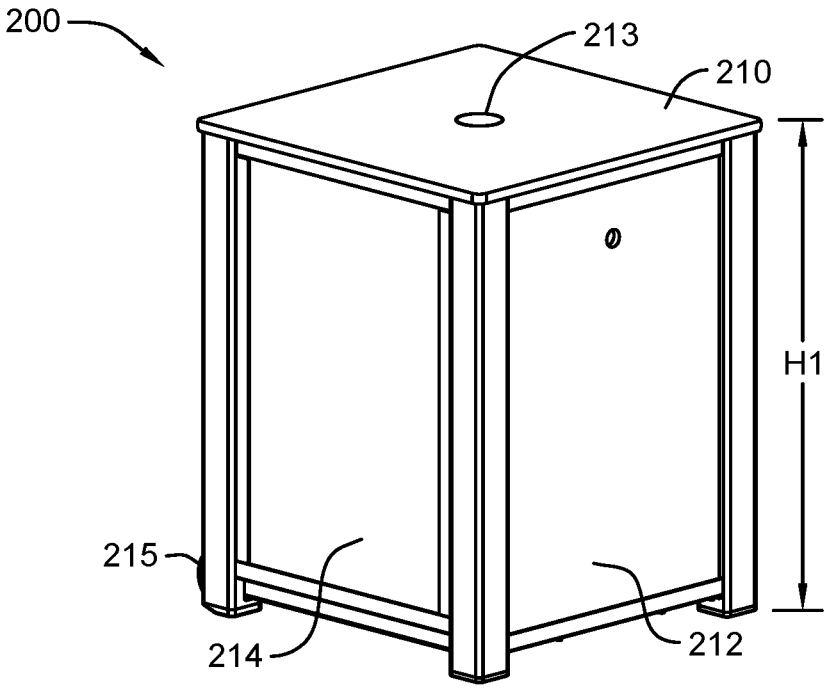
FIG. 3 is an enlarged front left perspective view of the housing assembly of the reconfigurable patio heater and patio umbrella assemblies of FIGS. 1 and 2, according to an embodiment of the present disclosure.
Figure 4:
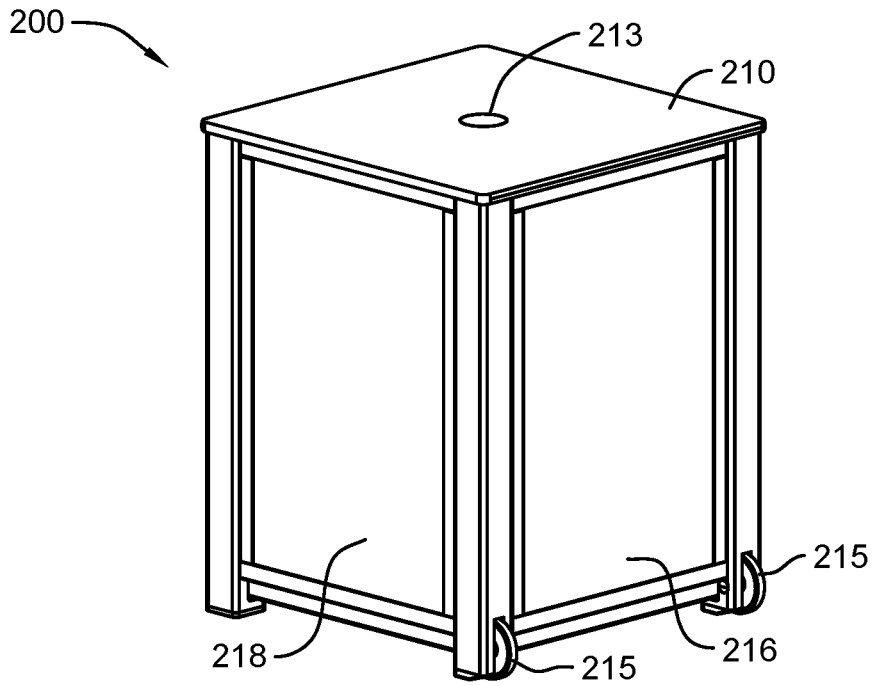
FIG. 4 is a rear right perspective view of the housing assembly of FIG. 3, according to an embodiment of the present disclosure.
Figure 5:
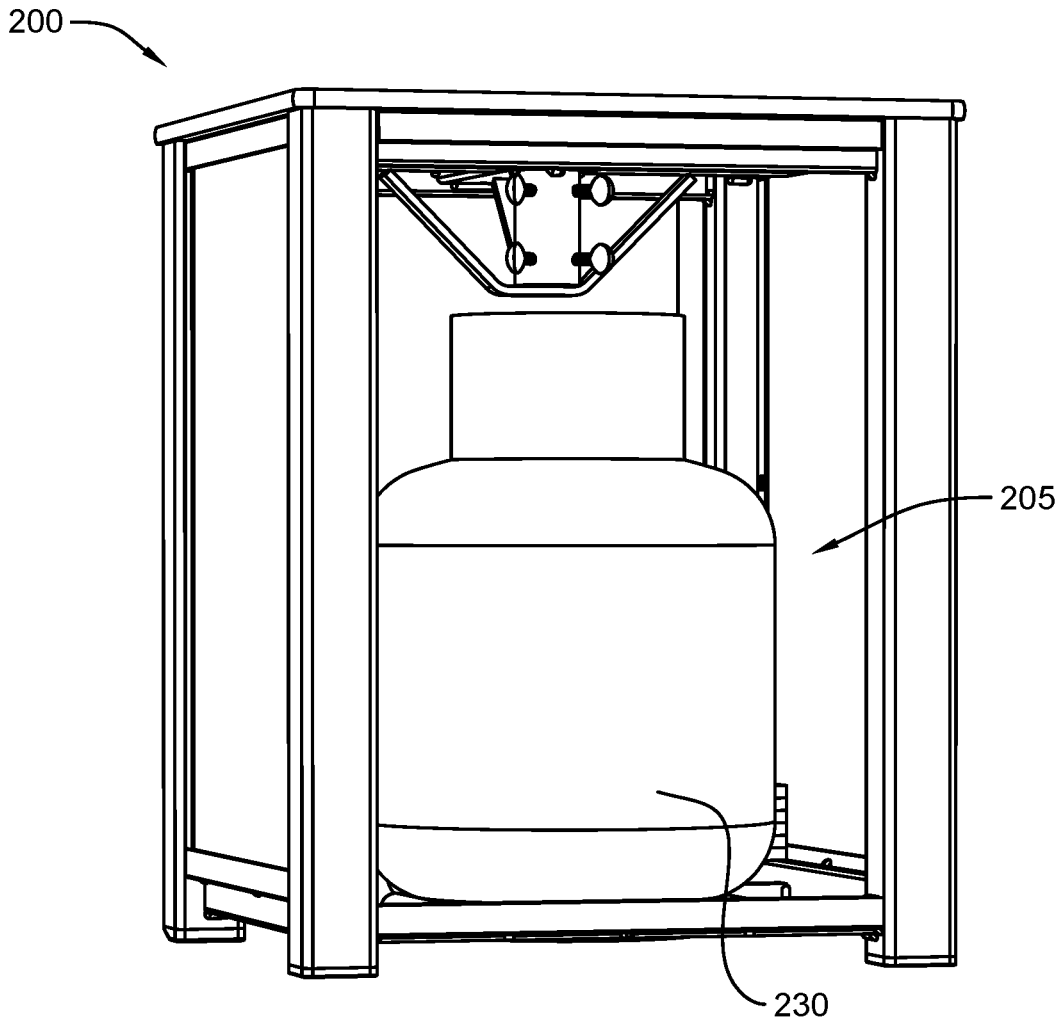
FIG. 5 is an enlarged perspective view of the housing assembly of FIG. 3 with the front sidewall removed, according to an embodiment of the present disclosure.

With reference to FIGS. 3 and 4, housing assembly 200 may have a general cube-shape or cuboid-shape configuration with a top 210, a front sidewall 212, a left sidewall 214, a right side wall 216, and a rear sidewall 218. Top 212 includes an aperture 213 extending through top 210. Housing assembly 200 may include a pair of wheels 215 to allow housing assembly to be tipped and moved on wheels 215. As shown in FIG. 5, housing assembly 200 may include a cavity 205 for concealing a tank 230 containing fuel such as liquid propane or natural gas.

Figure 6:
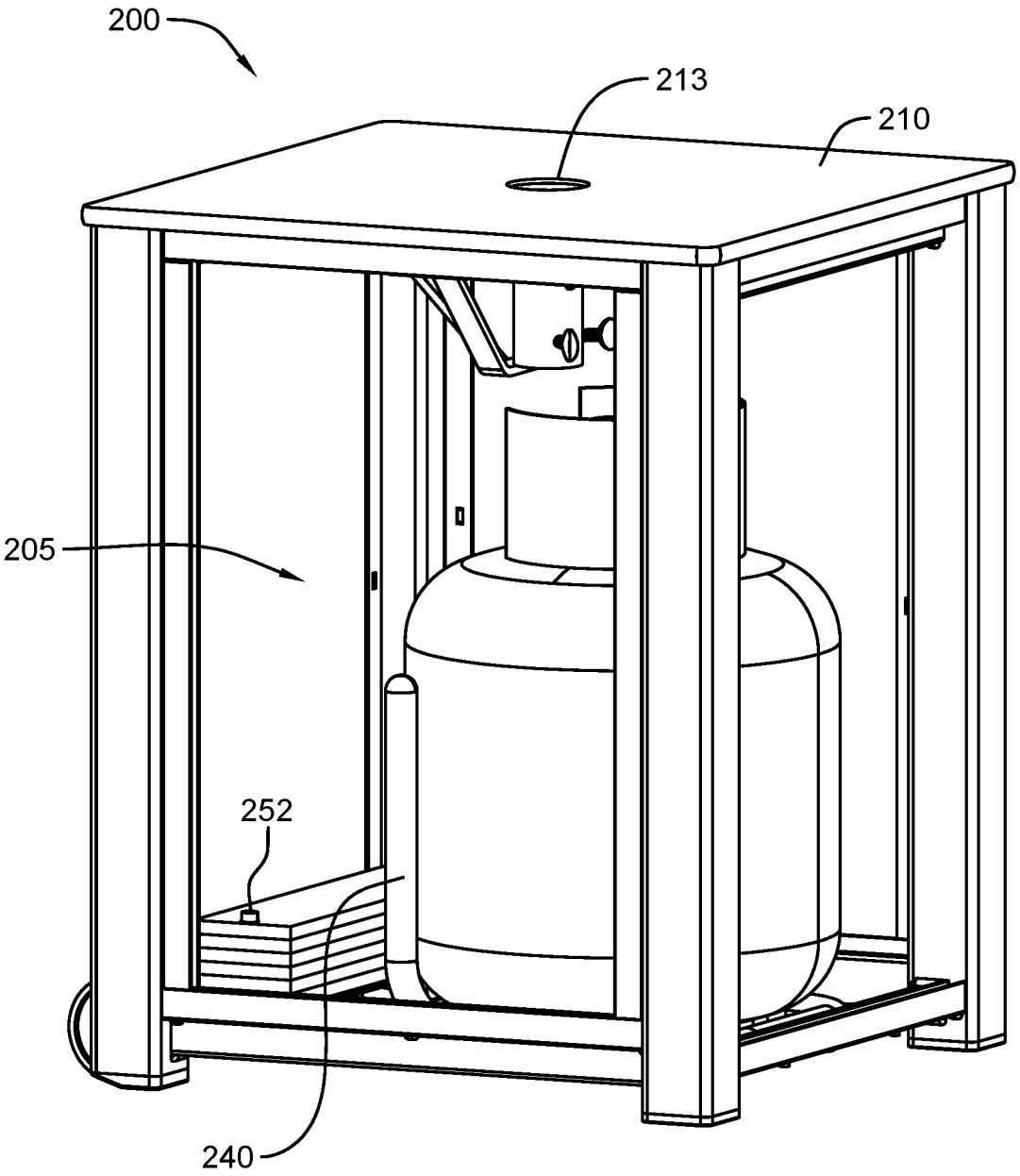
FIG. 6 is an enlarged perspective view of the housing assembly of FIG. 3 with the front and left sidewalls removed, according to an embodiment of the present disclosure.
Figure 7:
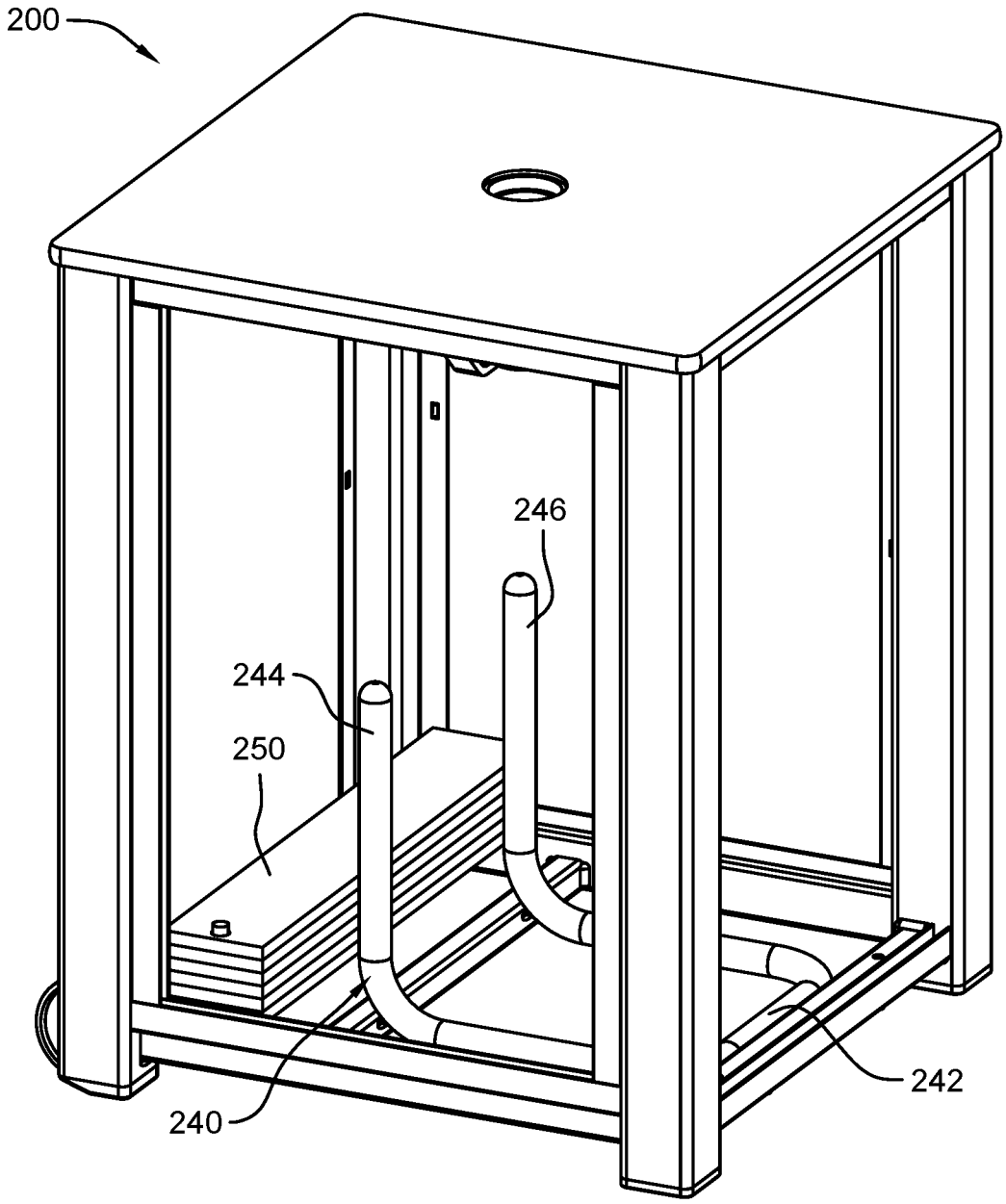
FIG. 7 is an enlarged perspective view of the housing assembly of FIG. 3 with the sidewalls removed, according to an embodiment of the present disclosure.

With reference to FIG. 6, tank 230 may be supported in a cradle 240. Tank 230 may be asymmetrical positioned within cavity 205. For example, tank 230 may be disposed in cradle 240 and positioned toward the front of housing assembly 200. As shown in FIG. 7, cradle 240 may have a horizontal U-shaped member 242, a first vertically-disposed upright 244, and a second vertically-disposed upright 246. A plurality of weights 250 may be provided for use in balancing the weight of housing assembly 200 with tank 230. The plurality of weights 250 may also allow housing assembly 200 to be stable when configured as a patio umbrella assembly without tank 230. In some embodiments, the plurality of weights 250 may include at least one hole so that the plurality of weights 250, e.g., rectangular planar weights, may be placed on vertically-disposed pegs 252. One or more sets of plates weighting about 10 pounds may be used for stability. By offsetting the tank, the housing assembly provides a large platform and a more stable base for the heater assembly and the umbrella assembly compared to conventional housings for patio heaters that are sized to closely and symmetrically surround the tank.

Figure 8:
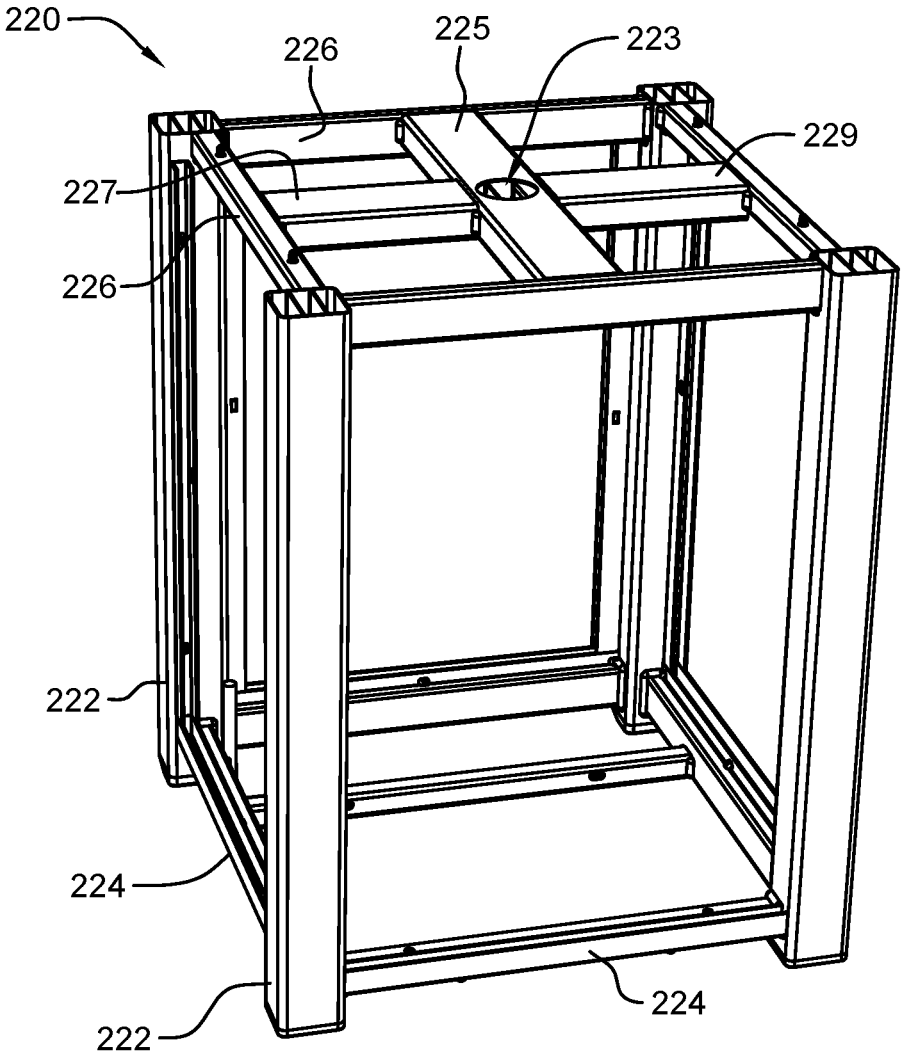
FIG. 8 is an enlarged perspective view of the frame of the housing assembly of FIG. 3, according to an embodiment of the present disclosure.

As shown in FIG. 8, housing assembly 200 may include a frame 220 formed from a plurality of vertical corner members 222, a plurality of lower horizontal members 224, and a plurality of upper horizontal members 226. A cross-member 225 spans between upper members 226. Cross-member 225 includes an aperture 223. A pair of cross-members 227 and 229 span between cross-members 226 and cross member 225. The sidewalls may be operably connected to the frame 220.

Figure 9:
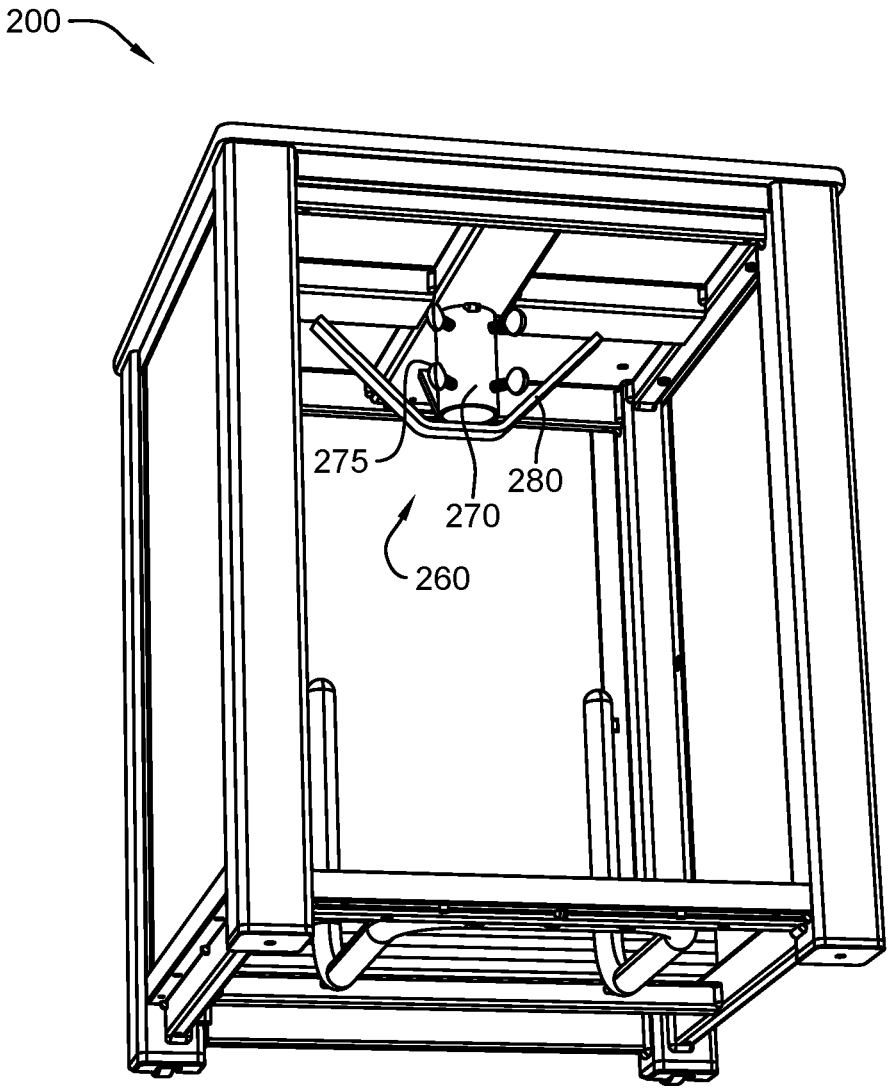
FIG. 9 is an enlarged perspective view of the housing assembly of FIG. 3 from below with the front sidewall removed, according to an embodiment of the present disclosure.

With reference to FIG. 9, a support 260 may be disposed below the top and above the tank for operably connecting to and supporting the lower portion of the post of the heater assembly or the pole of the umbrella assembly, according to an embodiment of the present disclosure. For example, support 260 may generally include a hollow collar 270, a plurality of thumb screws 275, and a U-shaped strap 280.

Figure 10:
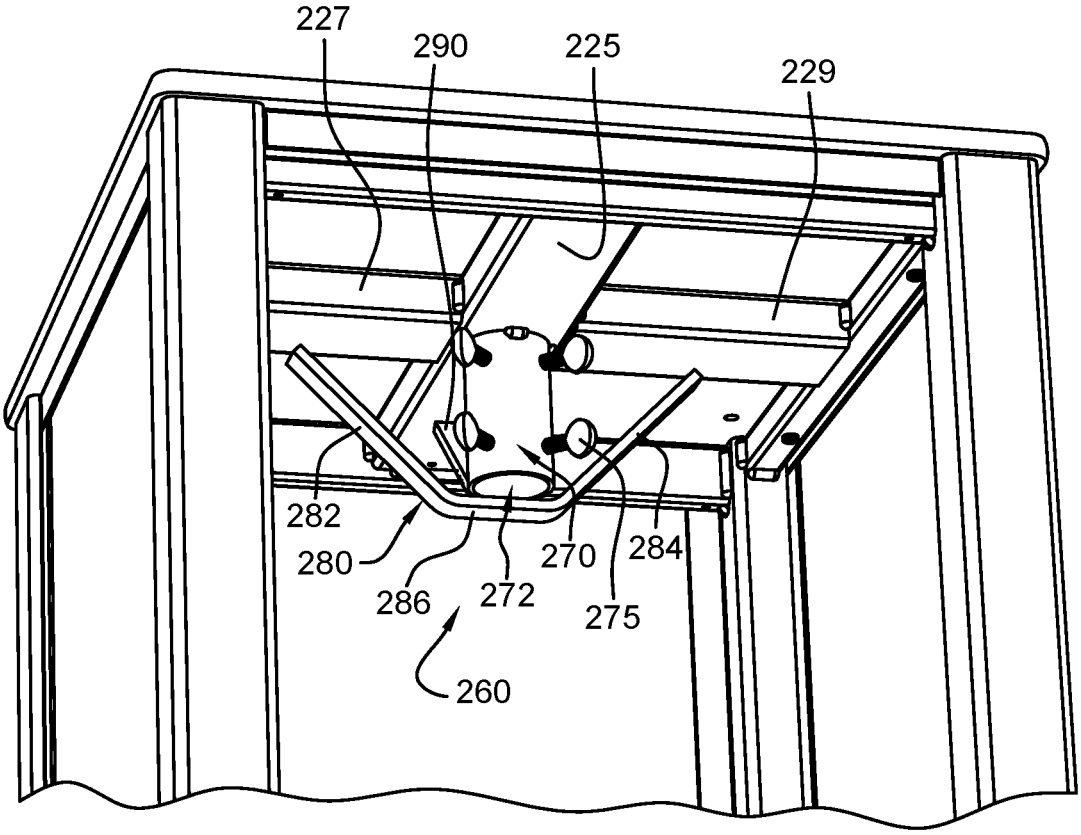
FIG. 10 is an enlarged partial perspective view of the housing assembly of FIG. 9 from below, according to an embodiment of the present disclosure.

As best shown in FIG. 10, collar 270 may include a channel 272 sized for receiving the lower portion of the post or pole. The plurality of thumb screws 275 may be disposed around collar 270 with ends of the thumb screws engageable with the lower portion of the post or pole. For example, the plurality of thumb screws 275 may be disposed along the front side of the housing assembly so that the lower portion of the post or pole is clamped between the inside of the rear portion of the collar on one side and the ends of the thumb screws on the other side. U-shaped strap 280 may include a first leg 282, a second leg 284, and a web 286 disposed between the first leg and the second leg. The upper portion of the first leg 284 is attached to cross-member 227 and the upper portion of the second leg 284 attached to cross-member 229. Support 260 may include a third leg 290 extending from web 286 and having an upper portion attached to the cross-member 225. As will be appreciated, the legs of the support provide a plurality of diagonally disposed members or struts having lower ends attached to the bottom portion of the collar, and upper ends spaced from the upper portion of the collar with the legs aiding in the ability to resist lateral forces from the heater assembly or the umbrella assembly.

Web 286 is disposed below and engages a portion of the lower end of the collar allowing access and passage of a hose connecting the heater to a regulator of the tank. For example, as described below, the web of the U-shaped strap is sized to allow passage of a quick disconnect hose connector through the collar and lower portion of the pole.

With reference again to FIG. 3, housing assembly 200 may have a height H1 between about 1½ feet and about 2½ feet. In some embodiments, the housing assembly may have a height of about 2 feet. The frame, sidewalls, and support of the housing assembly may be fabricated from aluminum or other suitable material or materials.

With reference again to FIGS. 6 and 8, aperture 213 in top 210 and aperture 223 in cross member 225 of housing assembly 200 may have a diameter of between about 1 inch to about 4 inches, between about 2 inches and about 4 inches, about 1 inch, about 1½ inches, about 2 inches, about 2¼ inches, about 2½ inches, about 3 inches, about 4 inches. The post of the heater assembly and the pole of the umbrella assembly may have an outside diameter slightly smaller than the apertures to be slidably receivable therein. In some embodiments, the apertures may have a diameter of about 2 inches for receiving the post of the heating assembly and the pole of the umbrella assembly, which post and pole may have an outside diameter of about 1½ inches, about 1¾ inches, or about 2 inches. For example, the apertures may have a diameter of about 2¼ inches, and the post and pole may have a diameter of 1¾ inches to about 2 inches. The collar 270 (FIG. 10) may be sized similarly to apertures 213 and 223 or may be sized smaller.

With reference again to FIG. 1, post 120 may have a height of about 4 feet. The heater may have a height of about 1¾ feet. The total height of the patio heater assembly may be between about 7 feet to about 8 feet, about 7½ feet, or other suitable height. The post may be a hollow post having a passageway therein and an outside diameter of 1¾ inches. It will be appreciated that the post may have a round cross-section, square cross-section, or other cross-section. For example, the size and shape of the hollow post may correspond to the size and shape of conventional umbrella poles.

With reference again to FIG. 2, pole 420 of umbrella assembly 20 may have a height between about 6 feet and about 7 feet, about 6 feet, about 6½ feet, or about 7 feet. The total height of the patio umbrella assembly may be between about 7 feet to about 11 feet, about 7½ feet, about 9 feet, about 11 feet, or other suitable height.

Figure 11:
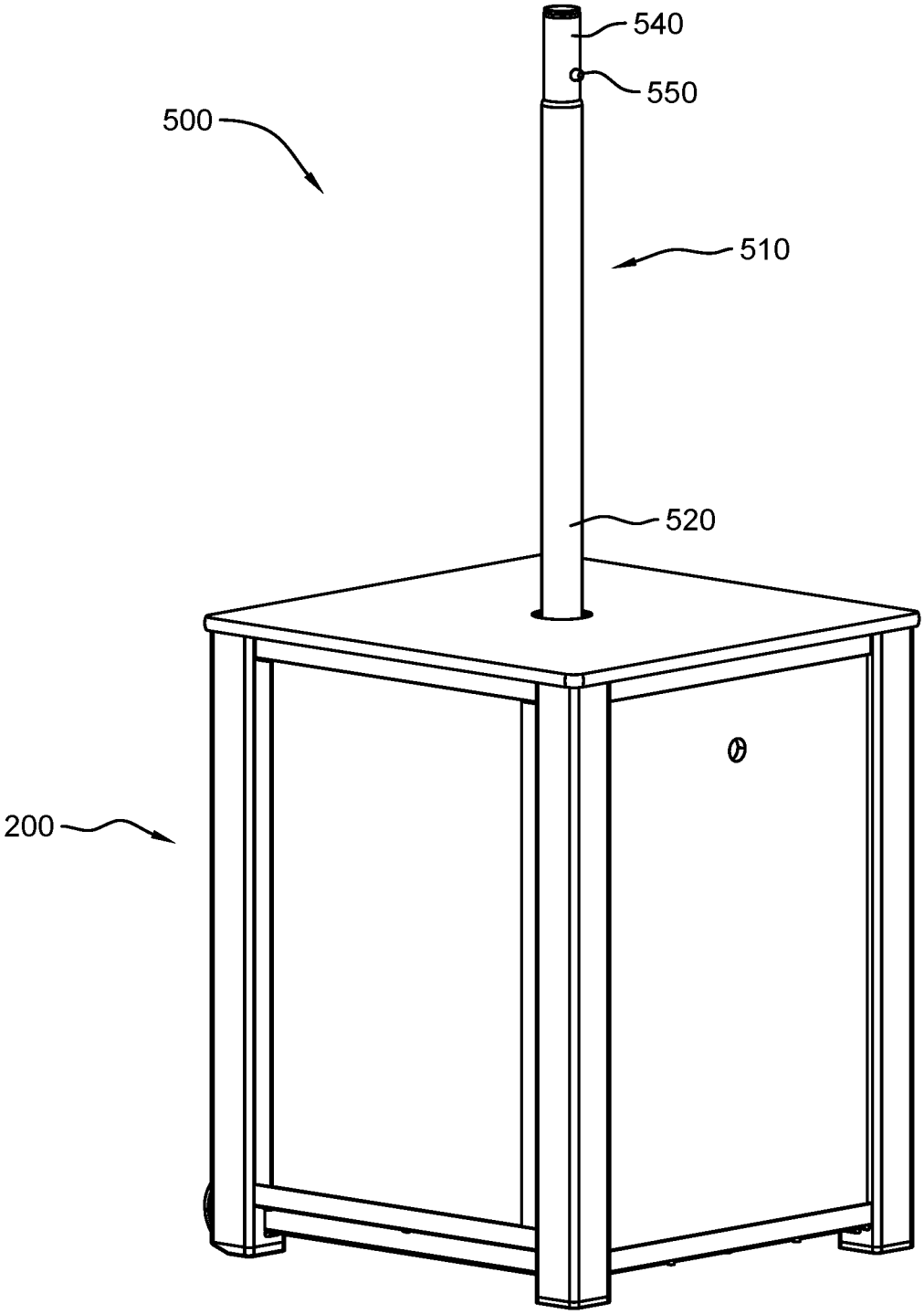
FIG. 11 is a front left perspective view of the housing assembly having an elongated extension for a reconfigurable patio heater assembly and patio umbrella assembly, according to an embodiment of the present disclosure.
Figure 12:
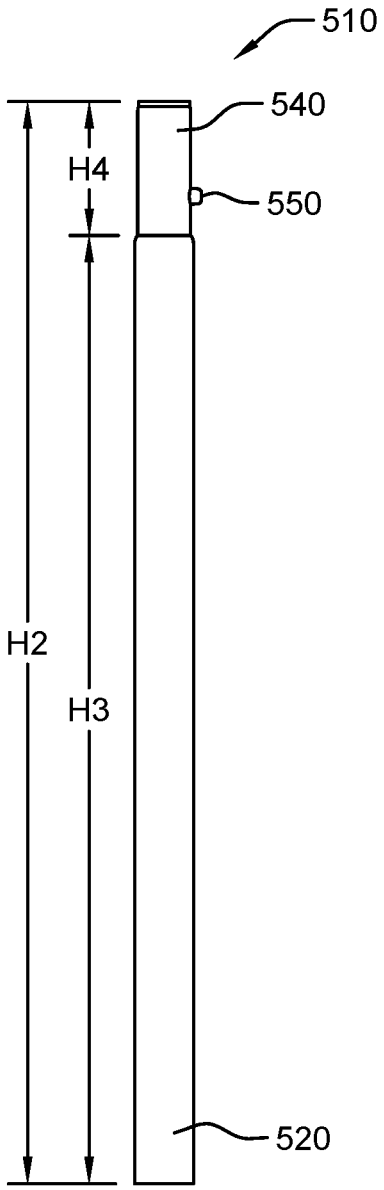
FIG. 12 is an enlarged side elevational view of the hollow elongated extension of the housing assembly of FIG. 11, according to an embodiment of the present disclosure.

FIG. 11 illustrates a housing assembly 500, according to an embodiment of the present disclosure. In this embodiment, housing assembly 500 may include housing assembly 200 and a hollow elongated extension 510 having a lower portion 520 attachable to housing assembly 200. As shown in FIG. 12, hollow elongated extension 510 may have lower portion 520 having a first diameter and upper portion 540 having a second diameter. The first diameter may be larger than the second diameter. For example, the first lower diameter may be about 1½ inches, and the second upper diameter may be about 1⅜ inches. The overall height H2 of elongated extension may be between about 2 feet and about 3 feet. For example, height H2 may be about 28 inches, the lower portion may have a height H3 of 24½ inches and the upper portion may have a height H4 of about 3½ inches.

Upper portion 540 of elongated extension 510 may include an outwardly-biased detent 550 for releasably and lockably connecting to the post of the heater assembly and the pole of the umbrella assembly. For example, a lower portion of a hollow post of the heater assembly and a hollow pole of the umbrella assembly may be readily slid over and onto the upper portion 540 and connected to upper portion 540 of the elongated extension 500 of the housing assembly. The detent may be pressed inwardly, and the lower portions of the post and the pole may include a hole alignable with detent 550. During removal of the heater assembly from the elongated extension of the housing assembly 500, the hose is disconnected from the tank or regulator, the detent is pressed inwardly, and the end of the hose of the heater assembly is passed through the elongated extension 510. The heater assembly may include a quick hose disconnector for connecting to a regulator of the tank. The hose and quick hose disconnector are sized to pass through the support in the housing assembly and the hollow elongated extension.

It will be appreciated that the elongated extension may allow use with conventional or standard umbrella assemblies having a two-piece pole. The elongated extension may be attached to the upper piece of the two-piece pole of the conventional or standard umbrella assembly.

In the various embodiments, a table may be disposed over the housing assembly with the post of the heater assembly or elongated extension passing though the aperture in the top of the table, or the pole of the umbrella assembly or elongated extension passing through an aperture in the top of the table. The table may include legs having a height sized for dining chairs, or may have legs having a height sized to allow people to stand around the table. The table may be a conventional table having and a symmetric top such as square or round tabletop, or may have an asymmetric tabletop such as rectangular or oval tabletop. The conventional table may include the top having a centrally disposed aperture such as a 2 inch diameter aperture. As will be appreciated, the present disclosure allows purchasers of conventional tables and chairs to use the reconfigurable assembly as a heater assembly or an umbrella assembly.

Figure 13:
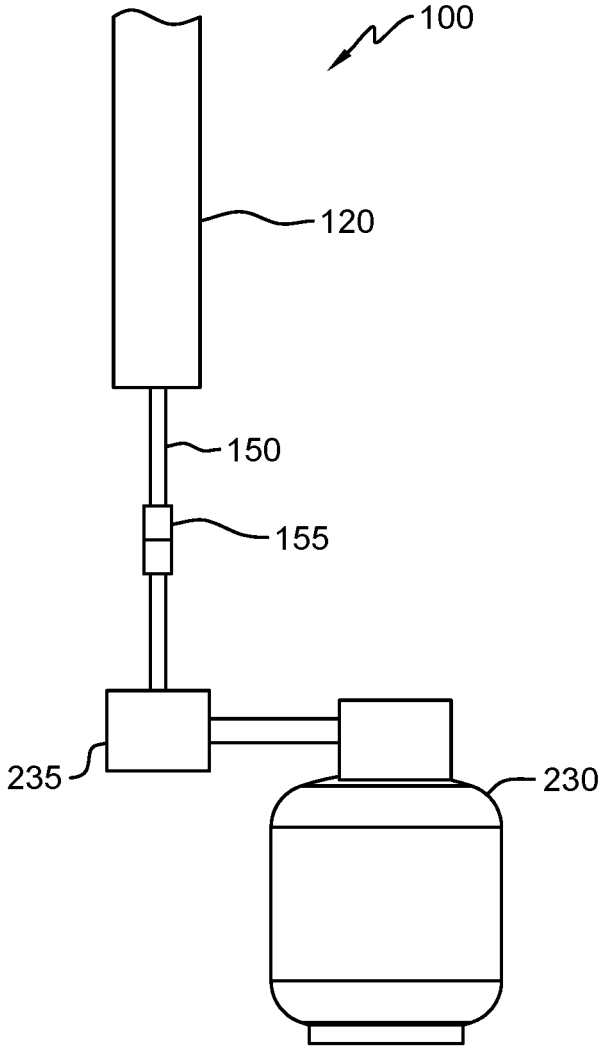
FIG. 13 is a diagrammatic illustration of portions of the heater assembly and housing assembly of FIG. 1, according to an embodiment of the present disclosure.

As shown in FIG. 13, heater assembly 100 may include a hose 150 having a quick disconnect 155, according to an embodiment of the present disclosure. One end of quick disconnector 155 may be readily connected to the end of hose 150, which hose extends through post 120 of heater assembly 100. The other end of quick disconnector 155 is attachable to a regulator 235, which regulator 235 is attachable to tank 230.

Figure 14:
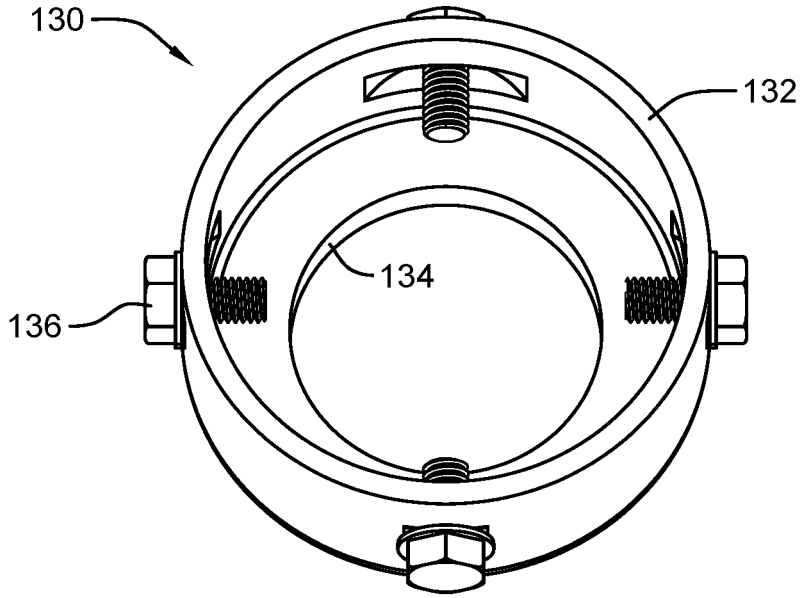
FIG. 14 is an enlarged top perspective view of the coupling of FIG. 1, according to an embodiment of the present disclosure.
Figure 15:
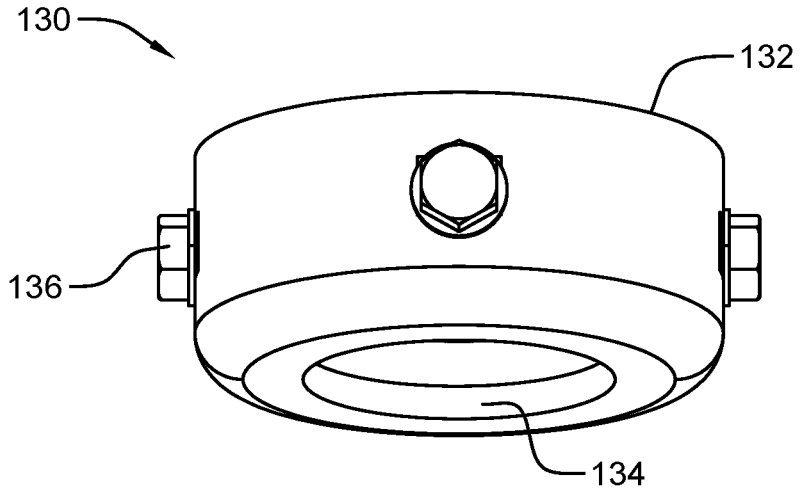
FIG. 15 is a bottom perspective view of the coupling of FIG. 14, according to an embodiment of the present disclosure.

With reference to FIGS. 14 and 15, coupling 130 may include an upper end portion 132 having a first size that may be connected via bolts 136 to the lower end of a conventional heater, and a lower end portion 134 having a second size sized to allow the post to pass therethrough and be welded or otherwise connected. The upper end portion of the coupling has a larger diameter than the diameter of the second lower end of the coupling. As will be appreciated, coupler 130 allows the post of the heater assembly to be used with conventional tables.

Figure 16:
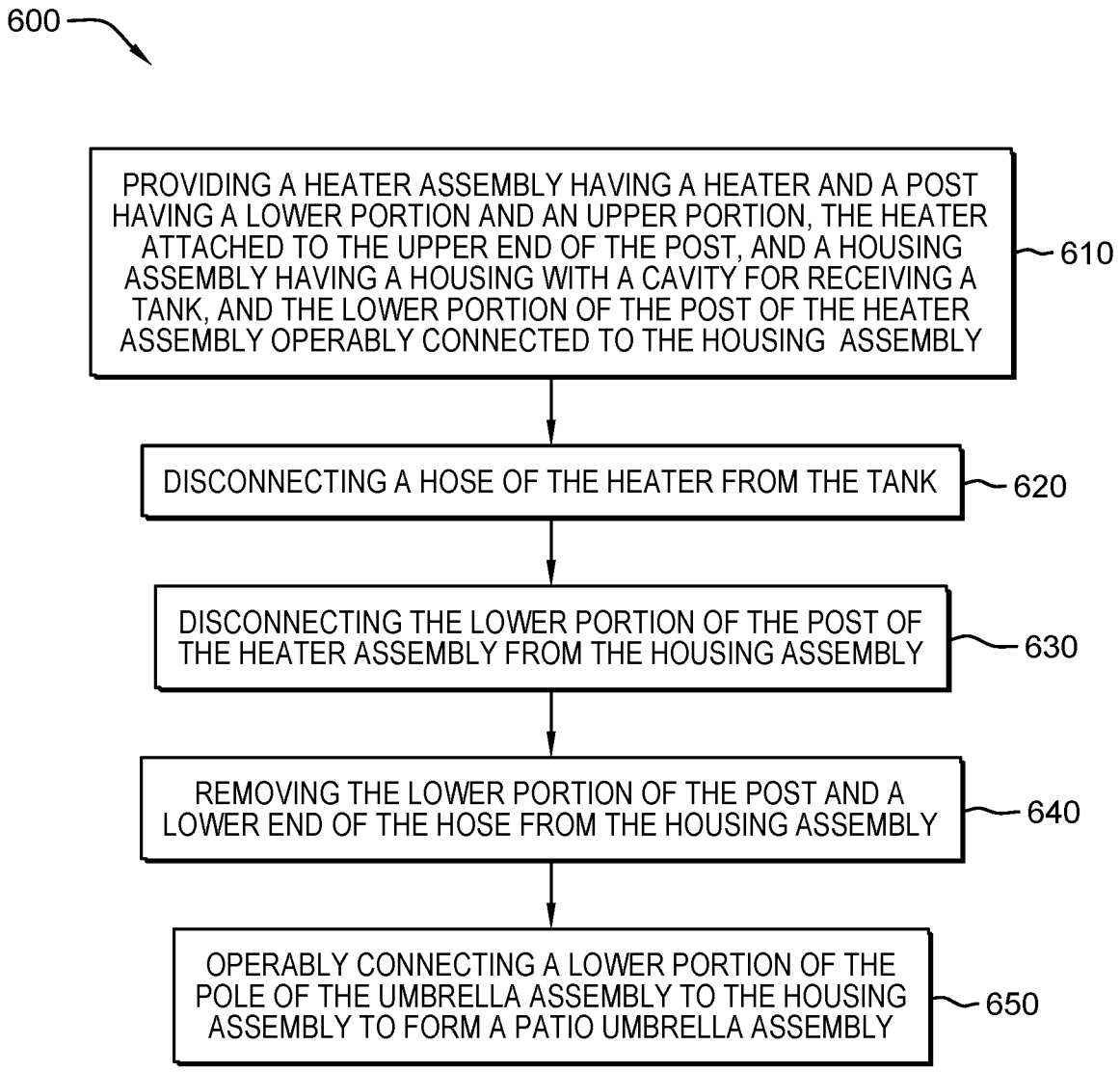
FIG. 16 is a flowchart of a method for reconfiguring an assembly as a patio heater assembly and as a patio umbrella assembly, according to an embodiment of the present disclosure.

FIG. 16 illustrates a method 600 for reconfiguring an assembly as a patio heater assembly or as a patio umbrella assembly, according to an embodiment of the present disclosure. In this illustrated embodiment, method 600 includes at 610 providing a heater assembly having a heater and a post having a lower portion and an upper portion, the heater attached to the upper end of the post, and a housing assembly having a housing with a cavity for receiving a tank, and the lower portion of the post of the heater assembly operably connected to the housing assembly, at 620 disconnecting a hose of the heater from the tank, at 630 disconnecting the lower portion of the post of the heater assembly from the housing assembly, at 640 removing the lower portion of the post and a lower end of the hose from the housing assembly, and at 650 operably connecting a lower portion of the pole of the umbrella assembly to the housing assembly to form a patio umbrella assembly.

Figure 17:
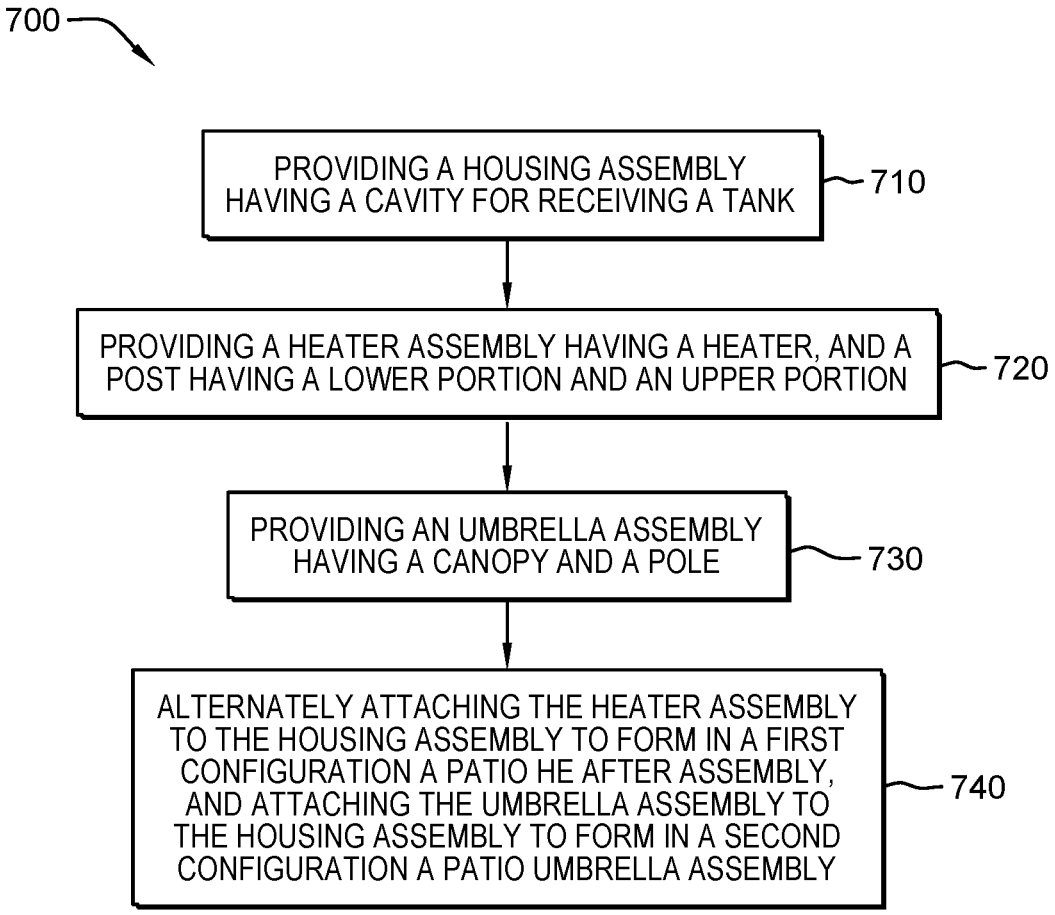
FIG. 17 is a flowchart of a method for reconfiguring an assembly as a patio heater assembly and as a patio umbrella assembly, according to an embodiment of the present disclosure.

FIG. 17 illustrates a method 700 for reconfiguring an assembly as a patio heater assembly or as a patio umbrella assembly, according to an embodiment of the present disclosure. In this illustrated embodiment, method 700 includes at 710 providing a housing assembly having a cavity for receiving a tank, at 720 providing a heater assembly having a heater, and a post having a lower portion and an upper portion, at 730 providing an umbrella assembly having a canopy and a pole, and 740 alternately attaching the heater assembly to the housing assembly to form in a first configuration a patio heater assembly, and attaching the umbrella assembly to the housing assembly to form in a second configuration a patio umbrella assembly. In some embodiments, method 700 may include alternately attaching a hose of the heater assembly to the tank in the first configuration and disconnecting the hose from the tank in the second configuration.

As may be recognized by those of ordinary skill in the art based on the teachings herein, numerous changes and modifications may be made to the above-described and other embodiments of the present disclosure without departing from the scope of the disclosure. In addition, the devices and apparatus may include more or fewer components or features than the embodiments as described and illustrated herein. Further, the above-described embodiments and/or aspects thereof may be used in combination with each other. Accordingly, this detailed description of the currently-preferred embodiments is to be taken as illustrative, as opposed to limiting the disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has", and "having"), "include" (and any form of include, such as "includes" and "including"), and "contain" (and any form of contain, such as "contains" and "containing") are open-ended linking verbs. As a result, a method or device that "comprises," "has," "includes," or "contains" one or more steps or elements possesses those one or more steps or elements, but is not limited to possessing only those one or more steps or elements. Likewise, a step of a method or an element of a device that "comprises," "has," "includes," or "contains" one or more features possesses those one or more features, but is not limited to possessing only those one or more features. Furthermore, a device or structure that is configured in a certain way is configured in at least that way, but may also be configured in ways that are not listed.

The disclosure has been described with reference to the preferred embodiments. It will be understood that the architectural and operational embodiments described herein are exemplary of a plurality of possible arrangements to provide the same general features, characteristics, and general apparatus operation. Modifications and alterations will occur to others upon a reading and understanding of the preceding detailed description. It is intended that the disclosure be construed as including all such modifications and alterations.

The invention claimed is:

1. A method comprising:

providing a patio heater assembly comprising:

a heater assembly comprising:

a heater; and a post having a lower portion and an upper portion, the heater attached to the upper end of the post;

a housing assembly comprising:

a housing having a cavity for receiving a tank for storing fuel; and the lower portion of the post of the heater assembly operably connected to the housing assembly;

disconnecting a hose of the heater from the tank;

disconnecting the lower portion of the post of the heater assembly from the housing assembly;

removing the lower portion of the post and a lower end of the hose from the housing assembly;

providing an umbrella assembly comprising:

a canopy; and a pole; and operably connecting a lower portion of the pole of the umbrella assembly to the housing assembly to form a patio umbrella assembly.

2. The method of claim 1 wherein:

the providing the patio heater assembly comprises:

attaching a coupling to the heater;

attaching the coupling to the post; and the post having an outside diameter between 1¾ inches and 2 inches.

3. The method of claim 1 wherein:

a height of the housing assembly comprises 2 feet;

a length of the post of the heater assembly comprises 4 feet; and a length of the pole of the umbrella comprises 6.5 feet.

4. The method of claim 1 wherein:

a length of the post of the heater assembly is less than a length of the pole of the umbrella assembly.

5. The method of claim 1 further comprising:

the providing the patio heater assembly comprises positioning a table over the housing assembly with the post of the heater assembly passing through an aperture in the top of the table;

positioning the table over the housing assembly with the pole of the umbrella assembly passing through the aperture in the top of the table;

wherein the aperture in the table has a diameter of 2 inches; and wherein the post and the pole have an outside diameter of 1¾ inches.

6. The method of claim 1 wherein:

the housing assembly comprises a hollow elongated extension having a lower portion attached to the housing assembly;

the lower portion of the post of the heater assembly connected to an upper portion of the elongated extension of the housing assembly;

the removing comprises removing the lower portion of the post and passing the end of the hose through the elongated extension; and the operably connecting comprises connecting a first portion of a two-piece pole of the umbrella assembly to the elongated extension to form a patio umbrella assembly.

7. The method of claim 6 wherein:

a length of the elongated extension is between 2 feet and 3 feet.

8. The method of claim 6 wherein:

the lower portion of the elongated extension comprises a first outside diameter;

the upper portion of the elongated extension comprises a second outside diameter;

the first outside diameter being greater than the second outside diameter; and the operably connecting comprises slidably positioning the pole of the umbrella on the upper portion of the elongated extension having the first diameter.

9. The method of claim 6 further comprising:

unlocking the lower portion of the post of the heater assembly from the upper portion of the elongate extension; and locking the lower portion of the pole of the umbrella assembly to the upper portion of the elongate extension.

10. A method comprising:

providing a housing assembly having a cavity for receiving a tank for storing fuel;

providing a heater assembly comprising:

a heater; and a post having a lower portion and an upper portion;

providing an umbrella assembly comprising:

a canopy;

and a pole; and alternately attaching the heater assembly to the housing assembly to form in a first configuration a patio heater assembly, and attaching the umbrella assembly to the housing assembly to form in a second configuration a patio umbrella assembly.

11. The method of claim 10 wherein:

the alternating attaching the heater assembly comprise:

alternately attaching a hose of the heater assembly to the tank in the first configuration and disconnecting the hose from the tank in the second configuration.

12. The method of claim 10 wherein:

the providing the patio heater assembly comprises:

attaching a coupling to the heater;

attaching the coupling to the post; and the post having an outside diameter between 1¾ inches and 2 inches.

13. A reconfigurable assembly comprising:

a housing assembly having a cavity for receiving a tank for storing fuel;

a heater assembly comprising:

a heater; and a post having a lower portion and an upper portion, the heater attached to the upper end of the post;

an umbrella assembly comprising:

a canopy;

and a pole; and wherein in a first configuration the lower portion of the post of the heater assembly is operably attached to the housing assembly to define a patio heater assembly; and wherein in a second configuration the lower portion of the pole of the umbrella assembly is operably attached to the housing assembly to define a patio umbrella assembly.

14. The reconfigurable assembly of claim 13 wherein:

a height of the housing assembly comprises 2 feet;

a length of the post of the heater assembly is less than a length of the pole of the umbrella assembly.

15. The reconfigurable assembly of claim 13 wherein:

the housing assembly comprises a hollow elongated extension having a lower portion attached to the housing assembly;

the post of the heater assembly attached to an upper end of the elongated extension in the first configuration; and the pole of the umbrella assembly attached to an upper end of the elongated extension in the second configuration.

16. The reconfigurable assembly of claim 13 further comprising:

a table positionable over the housing assembly with the post of the heater assembly passing through an aperture in the top of the table in the first configuration; and the table positionable over the housing assembly with the pole of the umbrella assembly passing through the aperture in the top of the table in the second configuration.

17. A patio heater assembly for use with a tank for storing fuel, the patio heater assembly comprising:

a heater assembly comprising:

a heater;

a hollow post having a lower portion and an upper portion, the heater attached to the upper portion of the post;

a hose extending from the heater to the lower portion of the post;

a housing assembly comprising:

a top;

at least one sidewall;

the top and the at least one sidewall sized to define a cavity for receiving the tank;

the top having an aperture, an upper surface, and a lower surface, and the aperture extending from the upper surface to the lower surface; and a support for operably connecting the lower portion of the post to the housing assembly with the hose attachable to the tank.

18. The patio heater assembly of claim 17 wherein:

the post having an outside diameter between 1¾ inches and 2 inches; further comprising a coupling having a first side connected to the heater and a second side connectable to the post.

19. The patio heater assembly of claim 17 wherein:

the support is disposed below the top of the housing assembly and above the tank; and the support comprises a hollow collar sized for receiving the lower portion of the post.

20. The patio heater assembly of claim 19 wherein:

the support comprises a U-shaped strap comprising a first leg having a first upper portion and a second leg having a second upper portion, and a web disposed between the first leg and the second leg;

the first upper portion of the first leg attached to the top and the second upper portion of the second leg attached to the top; and the web extending between lower ends of the legs and the web disposed below a lower end of the collar.

21. The patio heater assembly of claim 20 wherein:

the first leg is diagonally disposed member having lower end attached to the bottom portion of the collar, and upper ends spaced from the upper portion of the collar with the upper ends attached to the top.

22. The patio heater assembly of claim 20 wherein:

the U-shaped strap comprise a third leg extending from the web having an upper portion attached to the top.

23. The patio heater assembly of claim 21 wherein:

the support comprises a plurality of thumb screws disposed around the collar with ends of the thumb screws engageable with the lower portion of the post.

24. The patio heater assembly of claim 17 wherein:

the housing assembly comprises a cradle for asymmetrically positioning the tank in the cavity of the housing assembly.

25. The patio heater assembly of claim 17 wherein:

the housing assembly comprises a plurality of weights asymmetrically disposable in the cavity of the housing assembly.

26. The patio heater assembly of claim 25 wherein:

the housing assembly comprises at least one peg disposed in the cavity of the housing assembly;

the plurality of weights comprises at least one aperture extending therethrough; and the plurality of weights receivable on the at least one peg.

27. The patio heater assembly of claim 17 wherein:

the post has an outside diameter between 1¾ inches and 2 inches.

28. The patio heater assembly of claim 17 wherein the housing assembly comprises:

a height of 2 feet;

housing assembly comprises a square top having sides with a length of 20 inches; and the at least one sidewall comprises four sidewalls.

29. The patio heater assembly of claim 17 wherein:

the housing assembly comprises a hollow elongated extension;

the elongated extension attached to the support; and the lower portion of the post being portably connected to the elongated extension.

30. The patio heater assembly of claim 29 wherein:

the elongated extension comprises a length between 2 feet and 3 feet.

31. The patio heater assembly of claim 29 wherein:

the elongated extension comprises a detent for releasably locking post to the elongated extension.

32. The patio heater assembly of claim 17 wherein:

the heater assembly comprising a quick hose disconnector attached to a lower end of the hose.

33. The patio heater assembly of claim 17 further comprising:

an umbrella assembly comprising a canopy and a post.

* * * * *